United States Patent [19]

Green et al.

[11] Patent Number: 4,863,786

[45] Date of Patent: Sep. 5, 1989

[54] PAPERMACHINE CLOTHING

[75] Inventors: Alan Green, Manchester; Brian Riley, Blackburn, both of England

[73] Assignee: Scapa Group PLC, Blackburn, United Kingdom

[21] Appl. No.: 174,435

[22] Filed: Mar. 28, 1988

[30] Foreign Application Priority Data

Mar. 28, 1987 [GB] United Kingdom ..... 8707473

[51] Int. Cl.[4] ..... B32B 5/02

[52] U.S. Cl. ..... 428/234; 139/383 A; 162/358; 162/DIG. 1; 428/36; 428/222; 428/223; 428/246; 428/257; 428/300

[58] Field of Search ..... 139/383 AA; 162/DIG. 1, 162/358; 428/36, 222, 223, 234, 246, 257, 300

[56] References Cited

U.S. PATENT DOCUMENTS 4,186,780 2/1980 Josef et al. ..... 139/383 AA
4,418,726 12/1983 Josef et al. ..... 139/383 AA
4,529,643 7/1985 Lundström ..... 428/234
4,564,985 1/1986 Tanabe ..... 428/234
4,755,260 7/1988 Sakuma ..... 428/300

*Primary Examiner*—James J. Bell

*Attorney, Agent, or Firm*—Fleit, Jacobson, Cohn, Price, Holman & Stern

[57] ABSTRACT

The invention is concerned with a base fabric for use in the manufacture of a papermachine press-felt, the base fabric comprising a multi-layer endless woven fabric wherein the machine direction yarns of at least one fabric layer form interdigitated weft loops having a warp yarn therein, and thus define a seam, and wherein at least one further fabric layer exists. The further layer or layers may be continuous throughout the full longitudinal extent of the multilayer fabric, and are slit along the line of the seam after needling of a batt to the base fabric, or may be broken and the weft yarns woven tight about an extreme warp yarn.

14 Claims, 1 Drawing Sheet

PAPERMACHINE CLOTHING

The invention concerns papermachine clothing, and has particular, though not exclusive, reference to a multi-layer base fabric for use in the manufacture of press-felts.

It is known in the art to provide a multi-layer base fabric for combination with a batt of textile fibres to form a papermakers fabric, the base fabric comprising a flat-woven structure of which the warp yarns at the respective fabric faces are hand-woven back into the fabric to form two tiers of loops at each of the respective fabric ends, the loops being interdigitated and a respective pintle wire being inserted in the interdigitated loops of each tier to bring the fabric into endless form.

The process of hand-weaving the ends of the warp yarns back into the fabric to form warp loops is a slow and singularly tedious operation, and particularly so in the context of a multi-layer fabric wherein plural tiers of loops are formed at each fabric end.

It is also known to form a press-felt for a papermachine by needling a batt of fibres into two endless-woven fabrics arranged one within another, the batt providing a requisite surface to the press-felt and the needling operation serving to combine the batt and fabrics into a single coherent whole.

However, the endless nature of the press-felt so produced militates against its ready application to the press-section of the papermachine.

The object of the present invention is to provide a multi-layer base fabric for use in the production of, for example, a press-felt, which is of seamed construction, thereby to facilitate application to the papermachine, yet which does not involve the hand-weaving operation necessary in the case of flat woven fabrics.

In its broadest aspect the present invention proposes a base fabric for use in the construction of papermachine clothing comprising an endless-woven, multilayer fabric wherein the weft yarns of at least one fabric layer form interdigitated weft loops having a jointing wire therein and wherein said multi-layer fabric includes at least one further fabric layer.

According to one aspect of the invention each said further fabric layer is a continuous layer.

According to another of its aspect the present invention provides a base fabric comprising a woven, multilayer fabric having loops at the respective fabric ends formed by longitudinally extending yarns existing at a first fabric surface, the loops at the respective fabric ends being interdigitated to define a tunnel receiving a pintle wire therein joining said ends, characterised in that the said further fabric layer includes further longitudinally extending yarns existing at a second fabric surface, being a surface opposite to said first fabric surface, said further yarns being woven tight about transversely extending yarns at said second surface and at the respective fabric ends, the multilayer fabric being woven endless and the said longitudinally extending yarns being weft yarns of the woven fabric.

According to a preferred feature of the invention the said further longitudinally extending yarns are woven two in a shed.

According to a further preferred feature of the invention, the said further longitudinally extending yarns comprise multifilament yarns.

The invention will now be described further, by way of example only, with reference to the accompanying diagrammatic drawings, in which.

Figure 1:
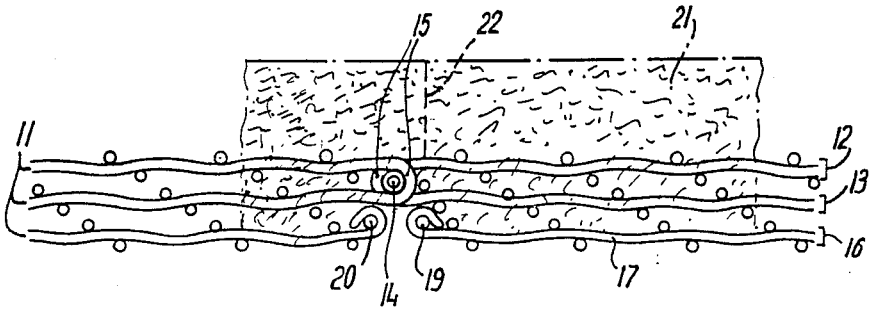
FIG. 1 is a longitudinal section through the seam region of a multi-layer base fabric in accordance with one aspect of the invention.
Figure 2:
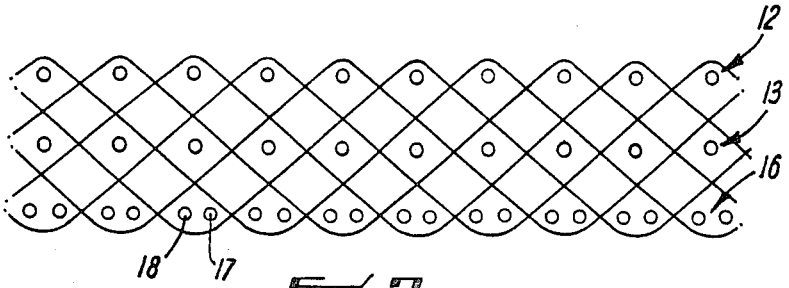
FIG. 2 is a typical transverse section through the multi-layer fabric shown in FIG. 1.

Referring now to the drawings, and particularly to FIGS. 1 and 2 thereof, a base fabric for use in the manufacture of a press-felt for a papermaking machine comprises a triplex weave structure of an endless-woven form of which the machine direction yarns 11 of the two upper layers 12, 13 thereof weave about an enlarged warp yarn 14 to form weft loops 15. The weft yarns of the lowermost layer 16 are woven two picks in a shed, with the individual picks 17, 18 of a pair existing in a common shed being woven about a respective retaining thread 19, 20 at an edge of the fabric as it exists in the loom.

In a typical example, the machine direction yarns of the upper weft layers 12, 13, as seen in FIG. 1, comprise monofilament synthetic yarns of a material conventionally used in the manufacture of press-felts and lying within the range 0.30 mm to 0.80 mm diameter, whilst the yarns of the bottom layer 16 of machine directions yarns comprise multifilament synthetic yarns. Alternatively, the yarns of the said bottom layer may be single monofilament of between 0.10 and 0.80 mm diameter or multi-ply or spun yarns of corresponding size.

Likewise, the cross-machine direction yarns in the example under consideration comprise synthetic monofilaments, and preferably are of a diameter of between 0.10 mm and 0.80 mm. However, such yarns may comprise plied monofilament, multifilament or spun yarns of like size.

The weave structure is such as to provide between 250 and 500 yarns per 10 cm in the machine direction and between 100 and 250 m yarns per 10 cm in the cross-machine direction of the fabric.

In producing a press-felt, a batt of fibres 21, as shown in chain dot in FIG. 1, will be applied to the paper-side of the base fabric, that is to say in contact with the top layer thereof as seen in the drawing, and will be made integral therewith by needling, the needled batt being slit, at 22, in alignment with, or in parallel offset disposition relative to, the enlarged warp yarn 14 (or pintle wire), thus to facilitate application of the press-felt to the papermaking machine. If desired, a further batt may be provided at the roller side of the fabric.

Figure 3:
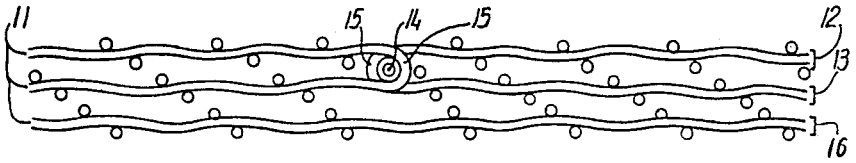
FIG. 3 is a view corresponding to FIG. 1, and illustrates another embodiment of the invention.

In an alternative arrangement, see FIG. 3, in which like references are used to those of FIG. 1, the weft yarns are not woven about respective retaining threads, but rather form an endless fabric layer which, after application of a fibre batt to the surface thereof and the needling of said batt into the multi-layer fabric, is slit, together with the batt, in register with the seam.

The invention is not limited to the particular weave structure shown in the accompanying diagrammatic drawings, and is believed to be of application in the context of other weave structures having three or more layers of yarn in a given direction.

Whilst that face of the fabric whereat the loops are provided will ordinarily be considered to be the paper side of the fabric the structure disclosed may serve as a base fabric for use in the production of a press-felt in either disposition.

In another arrangement, not illustrated, an endless-woven double-layer fabric, wherein selected weft yarns are woven about an enlarged warp yarn (or pintle wire) at an edge of the fabric as it exists in the loom to form a seamed endless fabric having weft loops of like kind to those of the embodiments of FIGS. 1 and 3, is combined with an endless-woven single-layer fabric arranged in overlying disposition relative thereto by needling a batt of fibres into engagement therewith, the fibres of the batt extending through the two fabric layers thus to form a coherent endless structure therewith. A fibrous batt may be provided at either or both faces of the base fabric, and, if required, at a position between the single and double layer fabric.

The pintle wire is withdrawn, and the batt (or batts) and single-layer fabric are slit in register with or in offset disposition relative to the weft loops, to give an open-ended press-felt which can be seamed by interdigitating the loops at the respective fabric ends and re-inserting the pintle wire.

What is claimed is:

1. A base fabric for use in the construction of papermachine clothing, said base fabric comprising:

circular woven warp and weft yarns forming an endless-woven, multilayer fabric, weft yarns of at least one fabric layer of said multilayer fabric defining interdigitated weft loops having a jointing wire therein and said multilayer fabric including at least one further fabric layer in addition to said at least one fabric layer, weft yarns of said at least one further fabric layer include said weft loops.

2. A base fabric as claimed in claim 1, wherein each said further fabric layer is a continuous layer.

3. A base fabric as claimed in claim 1, further comprising loops of said multilayer fabric engaged by a common warp yarn, said loops being formed by longitudinally extending yarns existing at a first fabric surface, said at least one further fabric layer includes further longitudinally extending yarns existing at a second fabric surface, being a surface opposite to said first fabric surface, said further yarns being woven tight about transversely extending yarns at said second surface and located generally in register with said warp yarns, said further longitudinally extending yarns being weft yarns of the woven fabric.

4. A base fabric as claimed in claim 3, wherein the said further longitudinally extending yarns are woven two in a shed.

5. A base fabric as claimed in claim 1, wherein the longitudinally extending yarns of the further fabric layer comprise multifilament yarns.

6. A base fabric as claimed in claim 1, comprising a three-layer fabric.

7. A papermachine fabric as claimed in claim 1 including a base fabric.

8. A papermachine fabric as claimed in claim 7, further including a textile batt needled to a surface of the woven multi-layer fabric.

9. A papermachine fabric as claimed in claim 8, wherein said textile batt is applied to the surface of the further fabric layer.

10. A papermachine fabric as claimed in claim 8, further including a textile batt needled to the other surface of the multi-layer fabric.

11. A papermachine fabric as claimed in claim 8, wherein each textile batt, and any continuous further fabric layer, is slit parallel to and adjacent the interdigitated loops.

12. A papermachine fabric as claimed in claim 8, wherein each said textile batt, and any continuous further fabric layer, is slit in slightly offset disposition relative to the interdigitated loops.

13. A base fabric for use in the manufacture of papermachine clothing, said base fabric having a cross-machine direction and a machine direction, said base fabric comprising:

circular woven warp and weft yarns respectively extending in the cross-machine and machine direction to form an endless, multilayer structure, the machine direction yarns of at least one fabric layer form interdigitated loops about a common warp yarn and including at least one further fabric layer in addition to said at least one fabric layer.

14. A papermakers press felt comprising a base fabric as claimed in claim 13, further including a textile batt needled to a surface of said base fabric and a slit in the batt in approximate register with said common weft yarn.

* * * * *